US008118609B2

(12) United States Patent
Sasaki et al.

(10) Patent No.: US 8,118,609 B2
(45) Date of Patent: Feb. 21, 2012

(54) ELECTRICAL CONNECTOR

(75) Inventors: Eiichi Sasaki, Kanagawa (JP); Takahiro Yoneda, Kanagawa (JP); Ryo Sawada, Machida (JP)

(73) Assignee: Tyco Electronics Japan G.K., Kanagawa-Ken (JP)

( * ) Notice: Subject to any disclaimer, the term of this patent is extended or adjusted under 35 U.S.C. 154(b) by 0 days.

(21) Appl. No.: 13/050,616

(22) Filed: Mar. 17, 2011

(65) Prior Publication Data

US 2011/0217864 A1 Sep. 8, 2011

Related U.S. Application Data

(63) Continuation of application No. PCT/JP2009/004407, filed on Sep. 7, 2009.

(30) Foreign Application Priority Data

Sep. 19, 2008 (JP) ..... 2008-240511

(51) Int. Cl.
*H01R 13/627* (2006.01)

(52) U.S. Cl. ..... 439/188; 439/489; 439/513

(58) Field of Classification Search ..... 439/188, 439/345, 489, 513, 595
See application file for complete search history.

(56) References Cited

U.S. PATENT DOCUMENTS

| | | | | |
|---|---|---|---|---|
| 5,647,754 | A | 7/1997 | Kohno | |
| 5,857,857 | A | 1/1999 | Fukuda | |
| 6,123,553 | A * | 9/2000 | Kobayashi et al. | 439/77 |
| 2011/0217864 | A1 * | 9/2011 | Sasaki et al. | 439/345 |
| 2011/0223789 | A1 * | 9/2011 | Sasaki et al. | 439/304 |

FOREIGN PATENT DOCUMENTS

| | | |
|---|---|---|
| JP | 64-41989 | 3/1989 |
| JP | 950850 | 2/1997 |

OTHER PUBLICATIONS

International Search Report cited in co-pending International Application No. PCTJP2009/004407, dated Oct. 20, 2009, 4 pages.

* cited by examiner

*Primary Examiner* — James Harvey
(74) *Attorney, Agent, or Firm* — Barley Snyder

(57) ABSTRACT

An electrical connector that can provide stable contact between a signal transmission terminal and a short-circuit terminal even if the connector is downsized. The connector includes a main body having a plurality of terminal receiving cavities provided with lances by which signal transmission terminals are secured and a plurality of short-circuit terminal receiving cavities adjacent to the terminal receiving cavities for receiving short-circuit terminals. Each short-circuit terminal includes a bent part at a forward position and a contact at a rearward position. The main body further includes a window that is formed at a position to the rear of the lances corresponding to the contacts of the short-circuit terminals and through which the terminal receiving cavities and the short-circuit terminal receiving cavities communicate with each other. The contacts of the short-circuit terminals are in contact with the female terminals through the window.

17 Claims, 11 Drawing Sheets

ELECTRICAL CONNECTOR

CROSS-REFERENCE TO RELATED APPLICATIONS

This application is a continuation of PCT International Application No. PCT/JP2009/004407 filed Sep. 7, 2009, which claims priority under 35 U.S.C. §119 to Japanese Patent Application No. JP 2008-240511, filed Sep. 19, 2008.

FIELD OF INVENTION

The present invention relates to an electrical connector and in a particular to an electrical connector having a short-circuit terminal for short-circuiting connecting signal transmission terminals.

BACKGROUND

An electrical connector for an air bag used in an automobile includes a male connector and a female connector. Male terminals for signal transmission positioned in the male connector are connected to a signaling side, such as a shock sensor, while female terminals for signal transmission in the female connector are connected to an apparatus side, such as an air bag unit. The connector has a function, among others, of short-circuiting the female terminals in order to prevent malfunction due to an accidental current flow to the apparatus side when the male connector and the female connector are separated from each other. The connector also has a function of breaking the short circuit between the female terminals when the male connector and the female connector are mated with each other (see Japanese Patent Laid-Open No. 9-50850, for example).

As shown in FIGS. 10 and 11, a known female connector 100 in which adjacent female terminals 120 are short-circuited includes a housing 110 having a plurality of terminal receiving cavities 111 for receiving female terminals 120 therein and the female terminals 120 received in the respective terminal receiving cavities 111 and locked by corresponding lances 112. The female terminal 120 has a contact piece 120*a* formed by folding back a front end part of the female terminal 120 and a contact protrusion 120*b* protruding to the inside of the terminal receiving cavity 111. A male terminal of a male connector (not shown) is electrically connected to the female terminal 120. An upper surface of the male terminal is in contact with the contact piece 120*a* and the lower surface is in contact with the contact protrusion 120*b*. The housing 110 has, at the front thereof, male terminal inlets 113 formed at positions corresponding to the positions of the terminal receiving cavities 111. In Japanese Patent Laid-Open No. 9-50850, a side of the female connector at which the male connector is mated therewith is defined as a front side, and the opposite side is defined as a rear side.

The female connector 100 has a U-shaped short-circuit terminal for short-circuiting a pair of female terminals 120 that are adjacent to each other in the width direction. As shown in Japanese Patent Laid-Open No. 9-50850, the conventional short-circuit terminal has a bent part formed at the rear thereof and a contact formed at the front thereof that is to come into direct contact with a female terminal, and the section from the bent part to the contact functions as a spring. The contact comes into elastic contact with the lower surface of the contact protrusion 120*b* of the female terminal 120 through a window 114 formed in a front part of the housing. Then, as shown by the arrow A in FIG. 10, an upward force is applied to the female terminal 120.

For the conventional female connector 100, the lances 112 are disposed above the female terminals 120 to which an upward force is applied. However, the lances 112 are elastically deformable and therefore cannot adequately absorb the upward force. As a result, the female terminals 120 are deformed to be bent upward, and the contact between the contacts and the female terminals 120 is unstable. Thus, there is a possibility that the short circuit between the paired female terminals 120 is broken, and a current may accidentally flow to the apparatus side, which causes malfunction.

If a housing wall that supports the female terminals 120 is formed at the front of the lances 112, the upward displacement of the female terminals 120 can be prevented. Actually, however, a mold member for forming the lances 112 has to be placed at the front of the lances 112, and therefore the housing wall cannot be formed at the front of the lances 112.

In addition, as a component of an automobile, there is a demand for minimizing the female connector 100. To meet the demand, the lance 112, which is a component of the female connector 100, also has to be reduced in size. However, if the size of the lance 112 is reduced, the strength of the lance 112 decreases, and the female terminal 120 is more easily deformed and bent upward.

In addition, for the known female connector 100, the window 114 is formed over a front end part of the terminal receiving cavities 111. Thus, as shown in FIG. 11, the female terminal 120 is held by the housing 110 only at the opposite side surfaces in the width direction. As a result, the female terminal 120 is likely to rotate about the axis thereof and be displaced. As the displacement becomes significant, the female terminals 120 is unable to smoothly mate with the male terminals.

SUMMARY

The present invention has been devised in view of such technical problems, and an object of the present invention, among others, is to provide a connector that can provide stable contact between a signal transmission terminal and a short-circuit terminal and prevent rotation of the signal transmission terminal about an axis thereof even if the connector is downsized.

To achieve the object described above, a connector according to the invention includes a main body having a plurality of terminal receiving cavities provided with lances by which signal transmission terminals are secured and a plurality of short-circuit terminal receiving cavities adjacent to the terminal receiving cavities for receiving short-circuit terminals. Each short-circuit terminal includes a bent part at a forward position and a contact at a rearward position. The main body further includes a window that is formed at a position to the rear of the lances corresponding to the contacts of the short-circuit terminals and through which the terminal receiving cavities and the short-circuit terminal receiving cavities communicate with each other. The contacts of the short-circuit terminals are in contact with the female terminals through the window.

BRIEF DESCRIPTION OF THE DRAWINGS

The invention is described in more detail in the following with reference to the embodiments shown in the drawings. Similar or corresponding details in the Figures are provided with the same reference numerals. The invention will be described in detail with reference to the following figures of which.

DETAILED DESCRIPTION OF THE EMBODIMENT(S)

Figure 1:
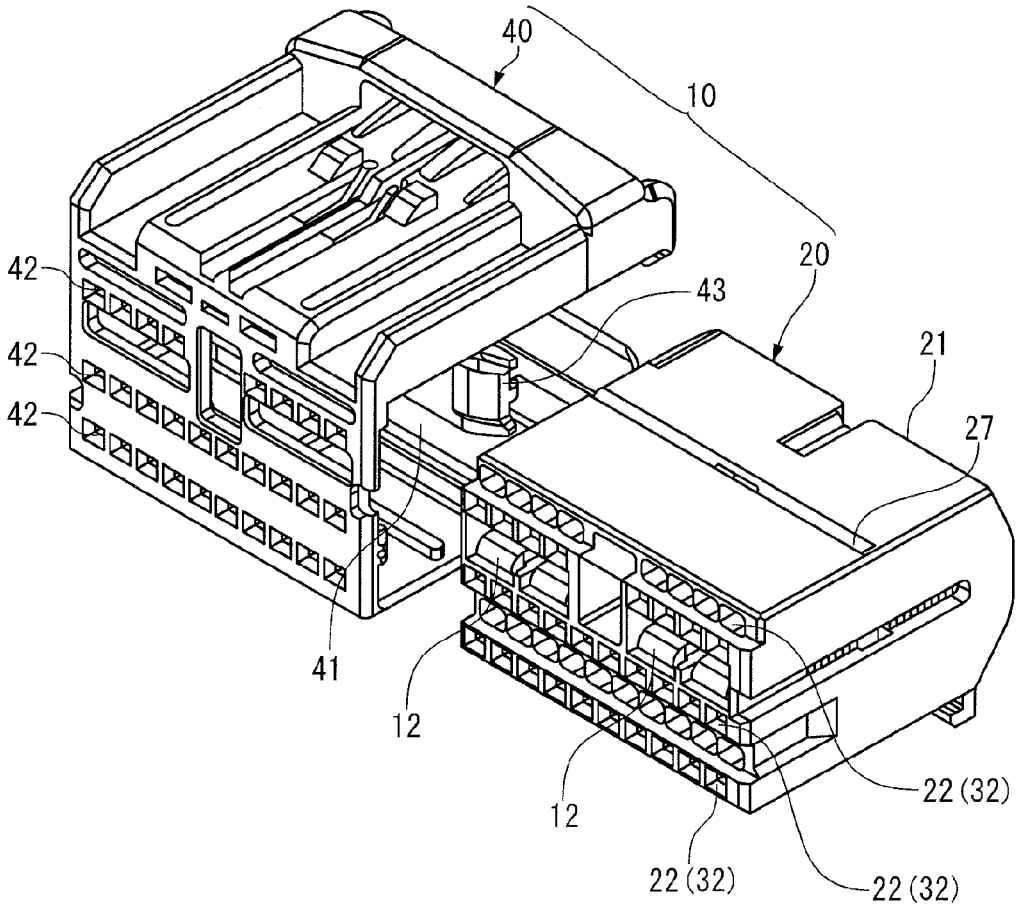
FIG. 1 is a front perspective view of a female connector according to the invention.
Figure 2:
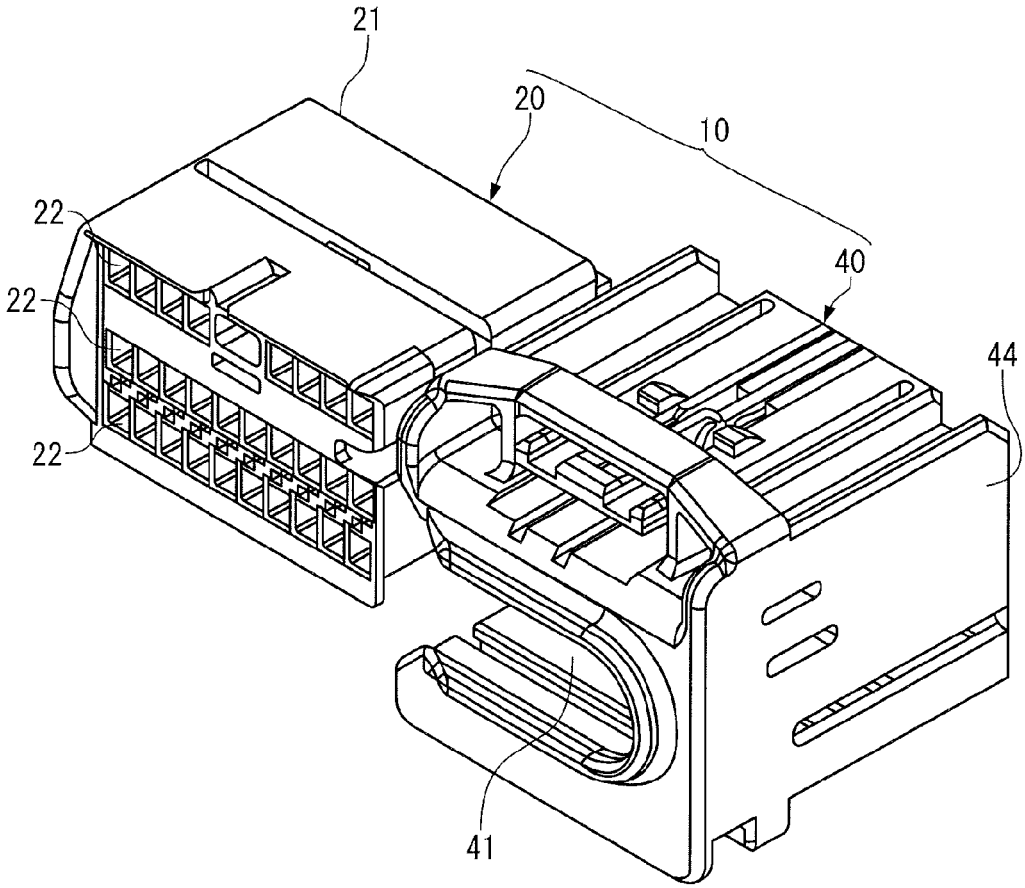
FIG. 2 is a rear perspective view of the female connector according to the invention.
Figure 3:
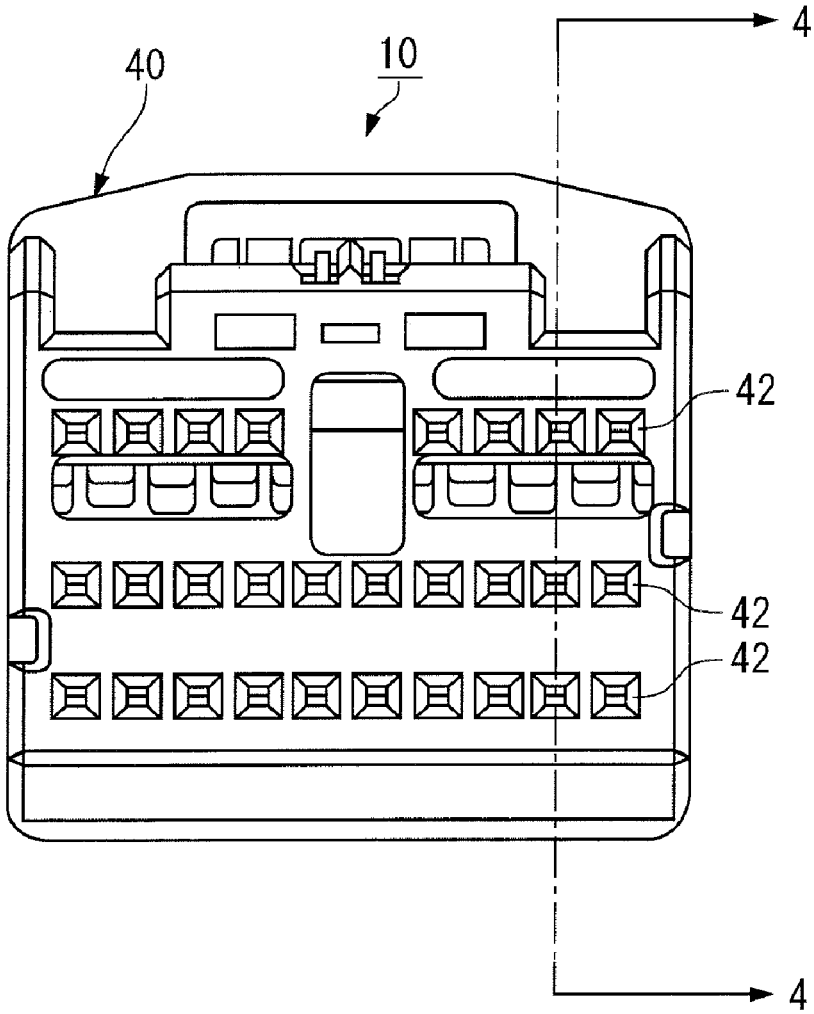
FIG. 3 is a front view of the female connector according to the invention.

In the following, an embodiment of the present invention will be described with reference to FIGS. 1 to 9.

In general, the shown embodiment relates to a connector used for an air bag for an automobile. However, other applications of the invention are possible.

A female connector 10 according to the invention includes a connector main body 20 and a housing 40 that houses the connector main body 20. The female connector 10 is to be mated with a male connector 60 described later.

A female terminal 11 (i.e. signal transmission terminal) of the female connector 10 is connected to an apparatus side of an air bag unit, and a male terminal 63 of the male connector 60 is connected to a signaling side, such as a shock sensor.

The connector main body 20 has a sub-housing 21 in which a plurality of terminal receiving cavities 22 for receiving a plurality of female terminals 11 therein are formed. The sub-housing 21 is integrally molded with the connector main body 20 from a resin material by injection molding in the embodiment shown. The terminal receiving cavities 22 are formed to penetrate the sub-housing 21 in the front-back direction of the sub-housing 21. Male terminal inlets 32 are formed in a front end part of the sub-housing 21 at positions corresponding to the positions of the terminal receiving cavities 22. Additionally, the sub-housing 21 has elastically deformable lances 23 facing the terminal receiving cavities 22. The female terminal 11 is secured by the lance 23. The female terminal 11 is also further secured when the connector main body 20 is fit into the housing 40.

Figure 4:
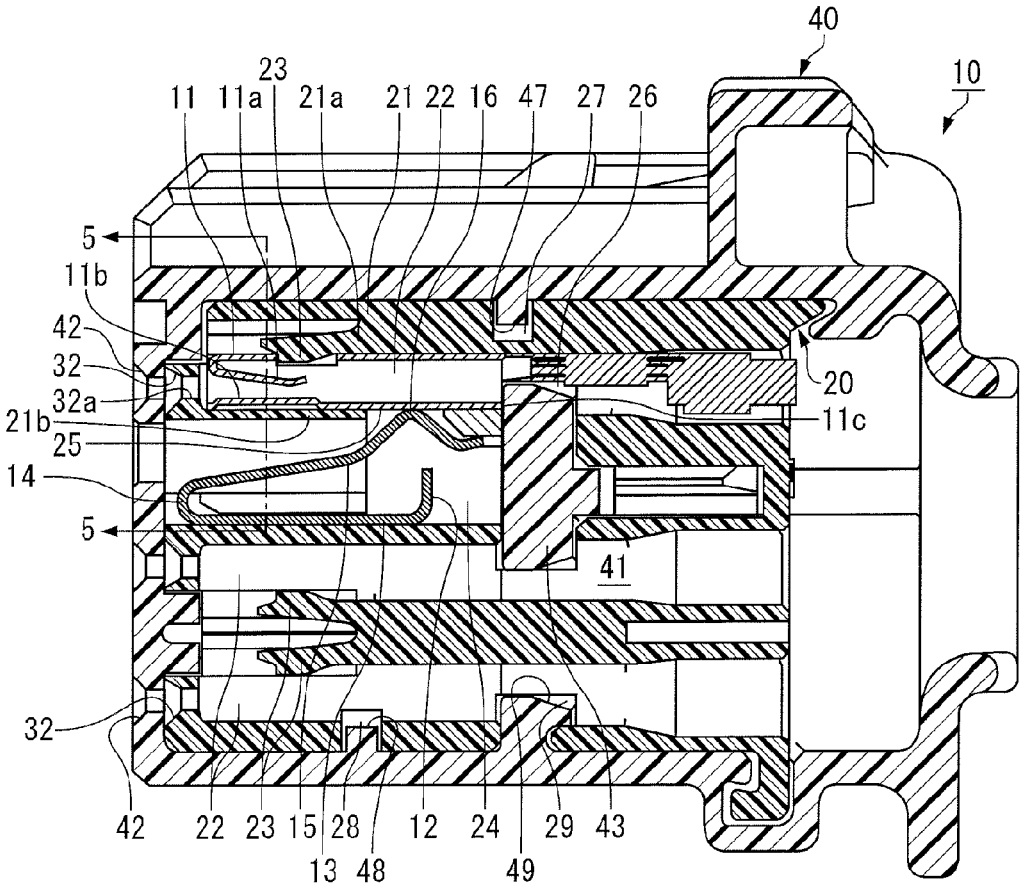
FIG. 4 is a sectional view of the female connector taken along the line indicated by the arrows 4 in FIG. 3.

The female terminal 11 is formed by stamping and bending a metal material that has both high strength and high conductivity. The female terminal 11 has a contact piece 11*a* formed by folding back a front end part thereof and a contact protrusion 11*b* protruding to the inside of the cavity 22. The male terminal 63 of the male connector 60 is electrically connected to the female terminal 11, wherein the upper surface of the male terminal 63 is in contact with the contact piece 11*a* and the lower surface is in contact with the contact protrusion 11*b*. In FIG. 4, illustration of the female terminals 11 positioned in the terminal receiving cavities 22 in the lower two rows is omitted.

According to the invention, two adjacent female terminals 11 received in the terminal receiving cavities 22 in the uppermost row may be paired. For instance, in the embodiment shown in Figures, there are eight cavities 22 in the uppermost row, and thus, there are four pairs of female terminals 11 in total. When the female connector 10 is separated from the male connector 60, the paired female terminals 11 are short-circuited, thereby preventing an accidental current flow to the air bag side. When the female connector 10 and the male connector 60 mate with each other, the short circuit between the paired female terminals 11 is broken.

Short-circuit terminal receiving cavities 24 for accommodating the U-shaped short-circuit terminals 12 therein are formed in a front part of the sub-housing 21. In the embodiment shown, the short-circuit terminal receiving cavities 24 are formed below the terminal receiving cavities 22 in the uppermost row. Four cavities 24 are arranged in the width direction of the sub-housing 21, with each cavity 24 associated with two cavities 22. The sub-housing 21 has a window 25 positioned to the rear of the lance 23 and through which the cavities 22 in the uppermost row and the cavities 24 communicate with each other.

The sub-housing 21 has a retainer insertion passageway 26 formed to the rear of the cavities 24. The retainer insertion passageway 26 is formed in the width direction of the sub-housing 21 perpendicular to the front-rear direction of the sub-housing 21. The retainer insertion passageway 26 communicates with the cavities 22 in the rows above and below the cavities 24. A retainer 43 formed on the housing 40 is inserted into the retainer insertion passageway 26. When the retainer 43 is inserted to a proper position in the retainer insertion passageway 26, the female terminals 11 are secondarily locked by the retainer 43.

The sub-housing 21 has a guide groove 27 formed in the upper surface and guide grooves 28 and 29 formed in the lower surface. The guide grooves 27, 28 and 29 are formed in the width direction of the sub-housing 21.

The short-circuit terminal 12 is formed by stamping and bending a metal material that has both high strength and high conductivity. The short-circuit terminal 12 has a bottom plate 13 to be fixed to the bottom surface of the cavity 24. The short-circuit terminal 12 further has a U-shaped bent part 14 formed by upwardly folding back a front end part of the bottom plate 13 and a spring 15 extending rearward from the bent part 14. The spring 15 has a contact 16 formed to protrude upward. In short, the short-circuit terminal 12 has the bent part 14 at the front thereof and the contact 16 at the rear thereof.

A positioning passageway 13*a* (see FIG. 5) is formed in the bottom plate 13, and a positioning protrusion 31 formed on the bottom surface of the cavity 24 is fit into the positioning passageway 13*a* to secure the short-circuit terminal 12 to the sub-housing 21.

The spring 15 branches into two sections. As a result, one short-circuit terminal 12 has two contacts 16. When the female connector 10 is separated from the male connector 60, the two contacts 16 maintain contact with the lower surfaces of the paired two female terminals 11 through the window 25. As a result, the paired two female terminals 11 are short-circuited. When the female connector 10 is mated with the male connector 60, a short-circuit breaking protrusion 62 formed on the male connector 60 is inserted between the lower surface of the female terminal 11 and the contacts 16 to press the contacts 16 down, thereby breaking the short-circuit (see FIG. 9).

The housing 40 has a connector receiving cavity 41 (referred to as a cavity 41 hereinafter) for receiving the connector main body 20 therein. The housing 40 is also integrally molded from a resin material by injection molding.

The cavity 41 has an opening on one side in the width direction of the housing 40, and the connector main body 20 is inserted into the cavity 41 through the opening. The housing 40 has a plurality of male terminal inlets 42 formed in the front end surface thereof at positions corresponding to the male terminal inlets 32 of the connector main body 20. The male terminals 63 of the male connector 60 are connected to the female terminals 11 through the male terminal inlets 42 and the male terminal inlets 32.

The retainer 43 to be inserted into the retainer insertion passageway 26 of the connector main body 20 is formed in the cavity 41 of the housing 40. The retainer 43 protrudes from the inner surface of a side wall 44 of the housing 40 opposite to the side where the opening is formed. When the connector main body 20 is fit into the housing 40, an engaging end 11*c* of the female terminal 11 abuts against the front end surface of the retainer 43, and thereby the female terminal 11 is secondarily secured.

The housing 40 has guide protrusions 47, 48 and 49 extending into the cavity 41. When the connector main body 20 is inserted into the cavity 41 of the housing 40, the guide protrusion 47 is inserted into the guide groove 27, the guide protrusion 48 is inserted into the guide groove 28, and the guide protrusion 49 is inserted into the guide groove 29, thereby guiding the connector main body 20 to a predetermined position in the cavity 41.

Figure 7:
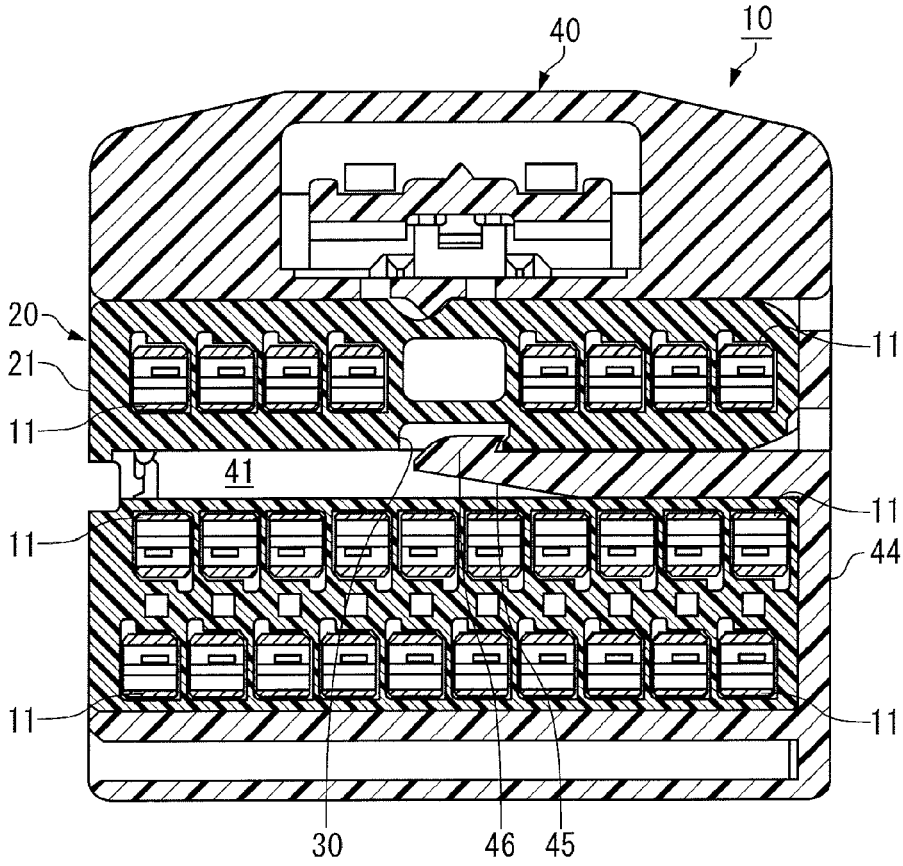
FIG. 7 is a sectional view of the female connector taken along the line indicated by the arrows 7 in FIG. 6.
Figure 8:
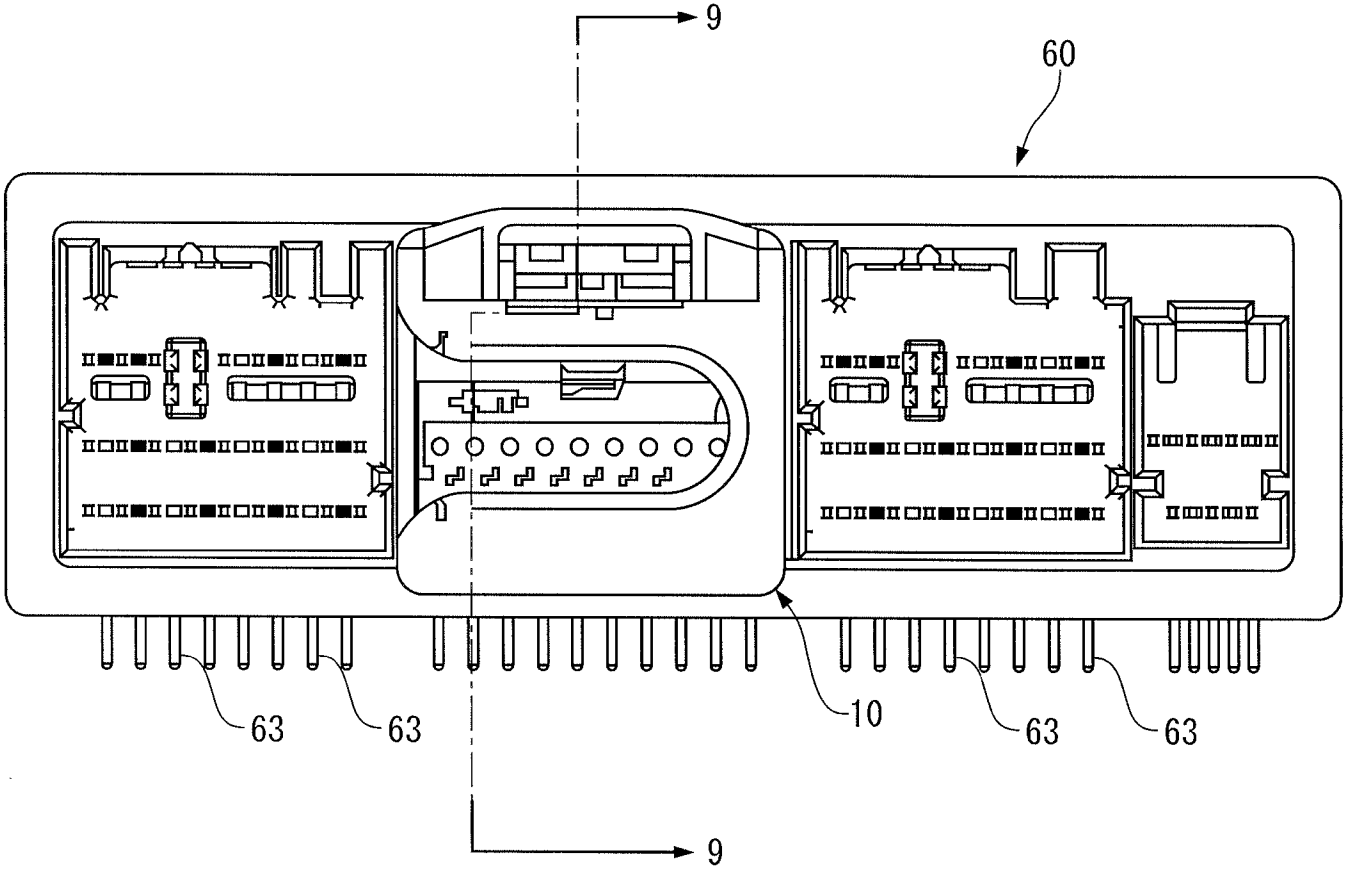
FIG. 8 is a front view of the female connector according to the invention mated with male connector.
Figure 9:
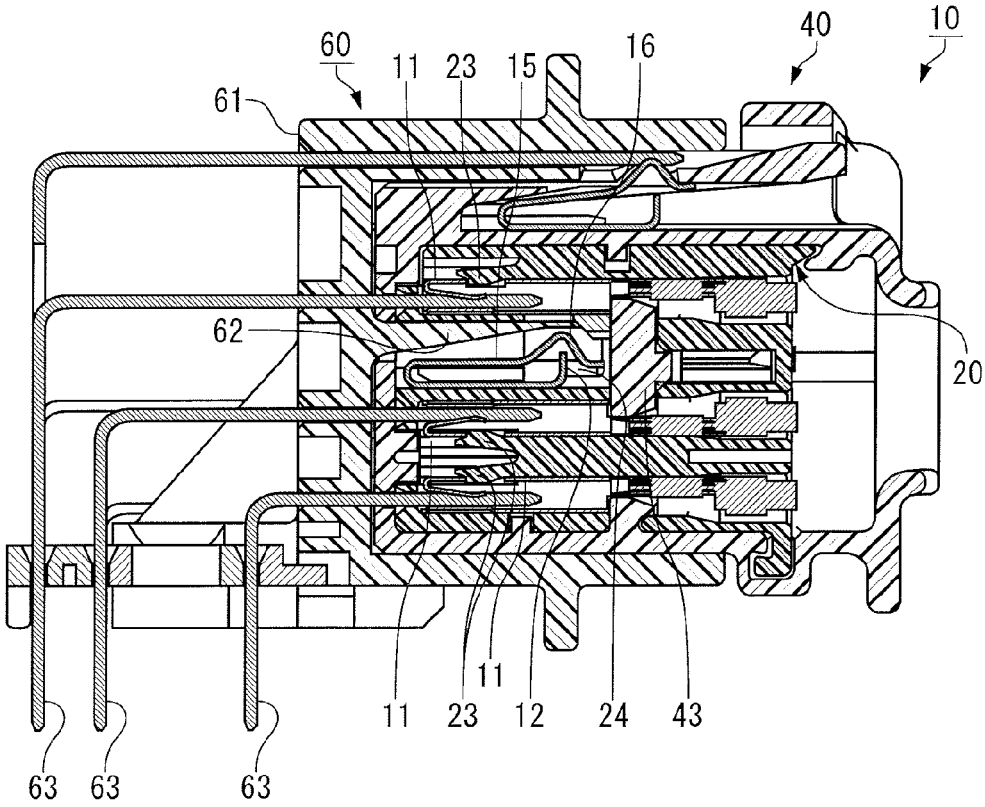
FIG. 9 is a sectional view of the female connector according to the invention and the male connector taken along the line indicated by the arrows 9 in FIG. 8.

The housing 40 has a lock 45 positioned to the rear of the retainer 43 in the cavity 41 (see FIG. 7). The lock 45 protrudes from the inner surface of the side wall 44 of the housing 40. The lock 45 has an engaging protrusion 46 protruding upward formed at the tip end thereof, and the engaging protrusion 46 is engaged with an engaging groove 30 formed in the sub-housing 21 to prevent the connector main body 20 from falling off the housing 40.

For the female connector 10, the short-circuit terminals 12 are inserted into the cavities 24 of the sub-housing 21 from the front. When the female terminals 11 are inserted into the cavities 22 of the sub-housing 21 from the rear, the female terminals 11 are secured by the flexible lances 23. The paired female terminals 11 come into contact with the contacts 16 of the short-circuit terminals 12 and are thereby short-circuited. Although the cavities 22 located above the cavities 24 have been described above, the female terminals 11 received in the cavities 22 below the cavities 24 are also secured by the lances 23.

The connector main body 20 provided with the female terminals 11 and the short-circuit terminals 12 is inserted into the cavity 41 through the opening of the housing 40. In this operation, the retainer 43 is inserted into the retainer insertion passageway 26 of the connector main body 20. When the connector main body 20 is inserted to a proper position, the engaging protrusion 46 formed at the tip end of the lock 45 is engaged with the engaging groove 30 of the sub-housing 21 to prevent the connector main body 20 from falling off the sub-housing 21. In addition, the engaging ends 11*c* of the female terminals 11 abut against the front end surface of the retainer 43, and thereby the female terminals 11, which have been secured by the lances 23, are further secured.

When the female connector 10 according to the invention is mated with the male connector 60, the male terminals 63 held in the housing 61 of the male connector 60 and the female terminals 11 held in the connector main body 20 of the female connector 10 are electrically connected to each other. When mated, the short-circuit breaking protrusions 62 formed on the housing 61 of the male connector 60 are inserted between the contacts 16 of the short-circuit terminals 12 and the female terminals 11 to press the contacts 16 down, thereby breaking the short-circuit of the paired female terminals 11 (see FIG. 9).

Characteristics of the female connector 10 according to the embodiment described above will be described in comparison with the known female connector 100.

For the known female connector 100, the elastically deformable lance 112 cannot adequately absorb the upward force applied to the female terminal 120. Thus, the female terminal 120 is likely to be deformed to be bent upward. As a result, the contact between the short-circuit terminal and the female terminal 120 is unstable.

To the contrary, as shown in FIG. 4, for the female connector 10 according to the invention, the bent part 14 of the short-circuit terminal 12 is positioned forward, and the contacts 16 of the short-circuit terminal 12 are located to the rear of the lance 23. An upper supporting wall 21*a* that defines the cavity 22 is formed above the contacts 16. The upper supporting wall 21*a* is more rigid than the lance 23, and therefore, the female terminal 11 is less likely to be deformed upward even if an upward force is applied to the female terminal 11 by the short-circuit terminal 12, for example. Therefore, contact between the female terminal 11 and the short-circuit terminal 12 is stable. As a result, the short circuit between the paired female terminals 11 can be stably maintained.

Figure 11:
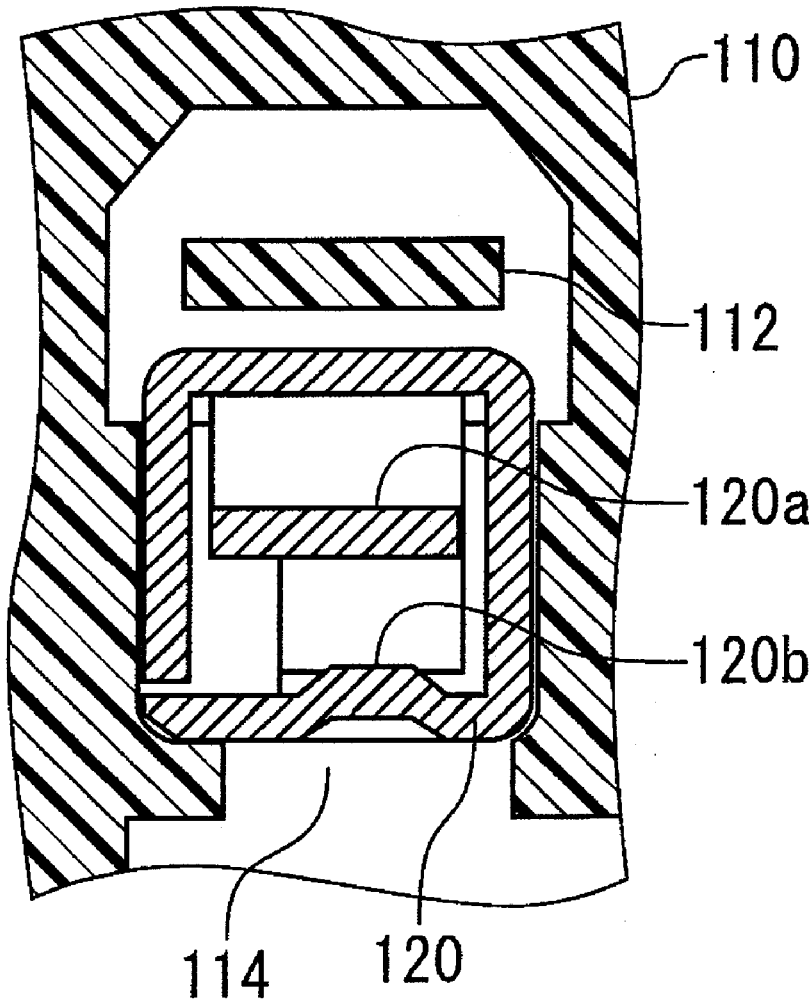
FIG. 11 PRIOR ART
FIG. 11 is a sectional view of the female connector taken along the line indicated by the arrows 11 in FIG. 10.

For the known female connector 100, the contact of the short-circuit terminal is in contact with the lower surface of the contact protrusion 120*b* of the female terminal 120. As shown in FIG. 11, the lower surface of the contact protrusion 120*b* is inclined at the opposite sides. If the contact protrusion 120*b* is in contact with the short-circuit terminal at the inclined surface, the contact area is insufficient, and the electrical connection between the short-circuit terminal and the female terminal 120 is also insufficient.

To the contrary, for the female connector 10 according to the invention, the contacts 16 are positioned to the rear of the lance 23. Since the contact protrusion 11*b* is displaced from the position corresponding to the contacts 16, the lower surface of the bottom plate 13 is flat at that position. Therefore, the female connector 10 according to the invention has a sufficient contact area between the contacts 16 and the female terminals 11, and therefore, the short circuit between the paired female terminals 11 can be stably maintained.

For the known female connector 100, as shown in FIG. 11, the window 114 is formed in the front end of the housing 110. As a result, the female terminal 120 is inadequately held at the front end, so that the female terminal 120 may rotate about the axis thereof and be displaced from the proper position. As the displacement becomes significant, it is difficult to smoothly mate the female terminals 120 with the male terminals.

Figure 5:
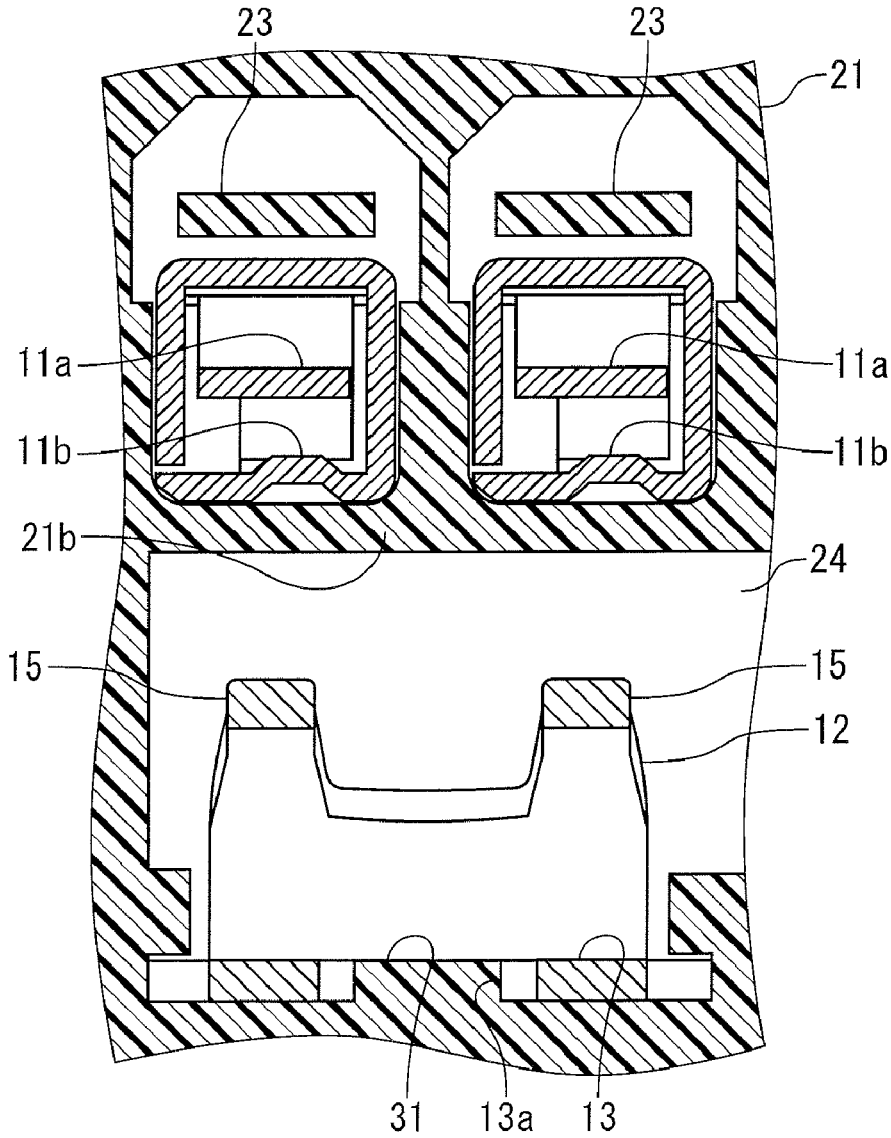
FIG. 5 is a sectional view of the female connector taken along the line indicated by the arrows 5 in FIG. 4.
Figure 6:
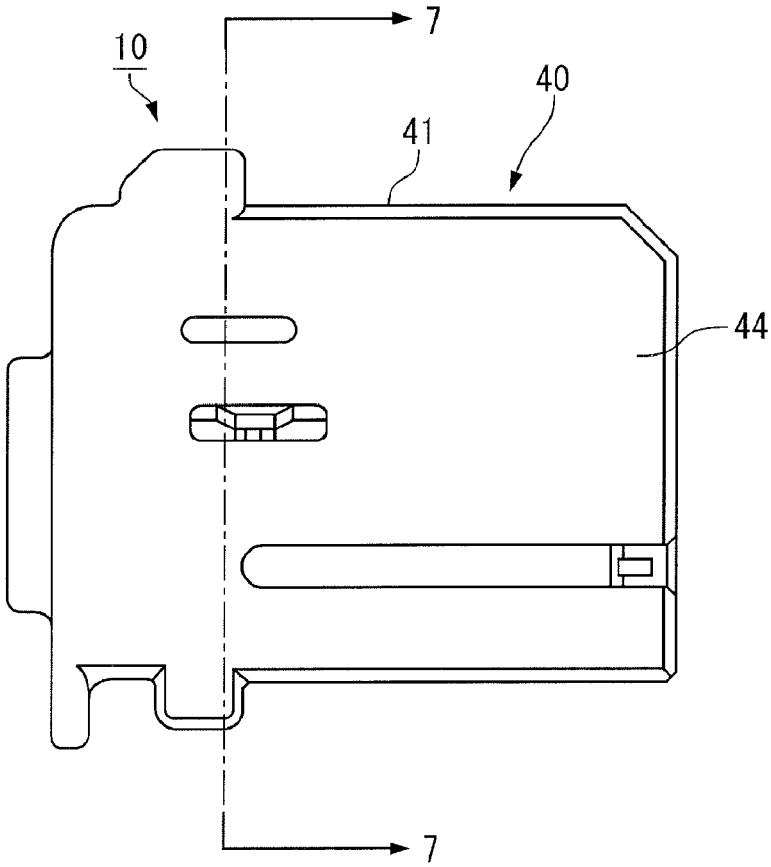
FIG. 6 is a side view of the female connector according to the invention.

To the contrary, for the female connector 10 according to the invention, there is a lower supporting wall 21*b* that supports the lower surface of the female terminal 11 at the front end of the sub-housing 21 (see FIG. 5). Therefore, at the front end of the sub-housing 21, the female terminal 11 is held not only at the opposite side surfaces in the width direction but also at the lower surface, so that the female terminal 11 is less likely to rotate about the axis thereof and is not significantly displaced. Thus, the female terminals 11 can be smoothly connected to the male terminals 63.

Figure 10:
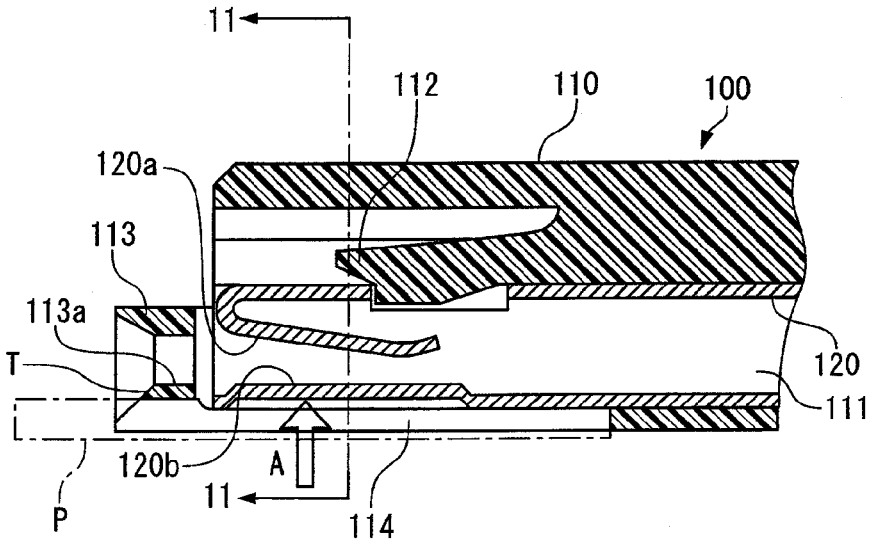
FIG. 10 PRIOR ART
FIG. 10 is a sectional view of a known female connector.

For the known female connector 100, in manufacturing of the housing 110 by injection molding, a molding pin P for forming the window 114 is inserted from the front (see FIG. 10). If the molding pin P is placed below the male terminal inlet 113 during injection molding, the thickness and strength of a lower wall 113*a* decreases accordingly. As the thickness of the wall 113*a* decreases, the length of an inclined surface T formed at the front end of the lower wall 113*a* decreases. As a result, the area for receiving the male terminal 63 decreases, and the possibility of failing to guide the male terminal 63 into the male terminal inlet 113 increases. If the female connector 10 and the male connector 60 are forcedly mated with each other when the tip ends of the male terminals 63 abut against the inclined surfaces T, the male terminals 63 may damage the wall 113*a*.

To the contrary, for the female connector 10 according to the invention, the retainer insertion passageway 26 extending in the width direction is formed in the sub-housing 21 of the connector main body 20 (see FIG. 4). To form the retainer insertion passageway 26 during the injection molding, a molding pin to form the retainer insertion passageway 26 is inserted in the width direction. If the molding pin has a shape corresponding not only to the retainer insertion passageway 26 but also to the window 25, the window 25 can be formed without the molding pin inserted from the front. In this case, unlike the known female connector 100, the thickness of a lower wall 32*a* of the male terminal inlet 32 does not decrease. As a result, compared with the known connector 100, the area for receiving the male terminal 63 increases, and the possibility that the male terminals 63 abut against and damage the wall 32*a* decreases.

Although an embodiment of the invention has been described above, the invention should not be construed as being limited to the embodiment. Although the embodiment described above relates to a connector used for an air bag, the present invention can be widely applied to a connector provided with signal transmission terminals to be short-circuited and a short-circuit terminal. The female terminals 11 to be short-circuited are not limited to those in the uppermost row in the sub-housing 21, and the female terminals 11 disposed in the lowermost row can also be short-circuited. It is, therefore, intended that the foregoing description be regarded as illustrative rather than limiting, and that the scope of the invention is given by the appended claims together with their full range of equivalents.

What is claimed is:

1. An electrical connector, comprising:

a main body having a plurality of terminal receiving cavities with flexible lances, a short-circuit terminal accommodating cavity adjacent to the terminal receiving cavities, a window, and an upper supporting wall;

signal transmission terminals received and secured by the lances in the terminal receiving cavities; and a short-circuit terminal having a U-shape with a bent part at a forward position and a contact at a rearward position, the short-circuit terminal received in the short-circuit terminal accommodating cavity;

wherein the window is positioned to the rear of the lances corresponding to the contact of the short-circuit terminal and through which the terminal receiving cavities and the short-circuit terminal accommodating cavity communicate with each other, the upper supporting wall is positioned to the rear of the lances corresponding to the contact of the short-circuit terminal, and the contact of the short-circuit terminal is in contact with the signal transmission terminals through the window.

2. The electrical connector according to claim 1, further comprising a housing that houses the main body.

3. The electrical connector according to claim 2, wherein the housing includes a retainer that secures the signal transmission terminals in addition to the lances.

4. The electrical connector according to claim 3, wherein the retainer locks the signal transmission terminals at a position to the rear of the short-circuit terminal.

5. The electrical connector according to claim 2, wherein the housing includes a connector receiving cavity and a guide protrusion extending into the connector receiving cavity.

6. The electrical connector according to claim 5, wherein the main body includes a guide groove.

7. The electrical connector according to claim 6, wherein the main body is inserted into the cavity of the housing, and the guide protrusion is inserted into the guide groove in order to guide the main body to a predetermined position in the cavity.

8. The electrical connector according to claim 5, wherein the housing includes a lock positioned to the rear of the retainer in the cavity.

9. The electrical connector according to claim 8, wherein the lock protrudes from an inner surface of a side wall of the housing.

10. The electrical connector according to claim 9, wherein the lock has an engaging protrusion protruding upward.

11. The electrical connector according to claim 10, wherein the main body includes an engaging groove, and the engaging protrusion of the housing engages with the engaging groove to prevent the main body from separating from the housing.

12. The electrical connector according to claim 1, wherein the main body includes terminal inlets that support the signal transmission terminals at a front end of the terminal receiving cavities.

13. The electrical connector according to claim 1, wherein the short-circuit terminal includes a spring that extends rearward from the bent part.

14. The electrical connector according to claim 6, wherein the spring branches into two sections.

15. The electrical connector according to claim 7, wherein the short-circuit terminal includes two contacts 16.

16. The electrical connector according to claim 8, wherein the two contacts maintain contact with lower surfaces of a pair of two signal transmission terminals through the window.

17. The electrical connector according to claim 1, wherein the short-circuit terminal further includes a bottom plate to be fixed to a bottom surface of the short-circuit terminal receiving cavity.

* * * * *